United States Patent [19]

Gertsch

[11] 4,073,509

[45] Feb. 14, 1978

[54] SAFETY SKI BINDING

[75] Inventor: Ulrich Gertsch, Matten, Switzerland

[73] Assignee: E. + U. Gerstch AG, Ski-Produkte, Interlaken, Switzerland

[21] Appl. No.: 654,650

[22] Filed: Feb. 2, 1976

[30] Foreign Application Priority Data

Feb. 14, 1975 Switzerland ..... 1868/75

[51] Int. Cl.[2] ..... A63C 9/081

[52] U.S. Cl. ..... 280/618; 280/620

[58] Field of Search ..... 280/620, 618, 611, 617, 280/636

[56] References Cited

U.S. PATENT DOCUMENTS

| | | | |
|---|---|---|---|
| 2,534,038 | 12/1950 | Lanz | 280/618 |
| 3,145,027 | 8/1964 | Berchtold et al. | 280/620 |
| 3,145,028 | 8/1964 | Cubberly | 280/620 |
| 3,359,010 | 12/1967 | Wick | 280/620 |
| 3,489,424 | 1/1970 | Gertsch et al. | 280/618 |
| 3,764, 155 | 10/1973 | Perryman | 280/618 |
| 3,845,964 | 11/1974 | Johnson | 280/636 |
| 3,930,661 | 1/1976 | Marker | 280/618 |

FOREIGN PATENT DOCUMENTS

| | | | |
|---|---|---|---|
| 1,271,671 | 8/1961 | France | 280/620 |
| 412,672 | 11/1966 | Switzerland | 280/620 |
| 265,226 | 2/1950 | Switzerland | 280/620 |

*Primary Examiner*—David M. Mitchell
*Attorney, Agent, or Firm*—Werner W. Kleeman

[57] ABSTRACT

A safety ski binding wherein the ski boot is clamped between an automatic heel portion of the binding and a pivotal jaw held in its operable position by spring force. The jaw is provided with a plate which engages beneath the sole of the ski boot and is fastened to the ski by means of a spring-loaded locking element arranged forwardly thereof and a pivot bearing engaging the plate.

13 Claims, 8 Drawing Figures

1
2
3
4
5
6
7
9
10
11
12
13
14
15
16
17
18

1
2
3
4
5
7
9
10
11
12
13
14

1
2
3
4
5
6
7
9
10
15
19
20
21
22
23

1
2
3
4
5
6
7
9
10
15
16
17
19
20
21
23

SAFETY SKI BINDING

BACKGROUND OF THE INVENTION

The present invention relates to a new and improved construction of a safety ski binding wherein the ski boot is clamped between a heel portion —sometimes referred to as an automatic heel portion— of the binding and a pivotal jaw held by spring force in its operable position.

In the case of safety ski bindings of this type the heel portion serves for the forward release action and the pivotal jaw provides for the lateral release action and, in some cases, the rearward release action. Thus, the characteristic of the lateral release is not solely dependent upon the adjustment of the pivotal jaw, it is also subject moreover to the friction prevailing between the sole of the ski boot and the standing surface at the ski. The coefficients of friction are subject to considerable fluctuations depending upon the properties and/or the momentary condition of the ski boot sole. Thus, for instance, the soiling of the ski boot sole can appreciably alter the release characteristic.

In order to overcome this problem there have already become known to the art so-called release plate bindings wherein the ski boot is attached to a plate which, in turn, is retained at the ski by means of one or a number of safety ski binding-release devices. During the release action of the safety ski binding the connection between the ski and the release plate is released, not however between the release plate and the ski boot. Consequently, what is decisive during lateral release is only the constant frictional conditions between the release plate and the ski and which frictional conditions have been reduced with the aid of suitable means.

SUMMARY OF THE INVENTION

It is a primary object of the present invention to transfer the advantages of the release plate type-bindings to a binding of the previously mentioned type, without having to connect the ski boot with the plate into a release unit.

Stated in another way, it is an object of this invention to provide a safety ski binding wherein it is possible, during a release action of the binding, to release the ski boot completely, but on the other hand to free the binding from possible influences arising from the ski boot, especially with regard to the lateral release action.

Now in order to implement these and still further objects of the invention, which will become more readily apparent as the description proceeds, the safety ski binding of this development is manifested by the features that the jaw possesses a plate engaging beneath the sole of the ski boot and this plate is secured or fastened to the ski by means of a spring-loaded locking element arranged forwardly of the plate and a pivot bearing engaging the plate.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
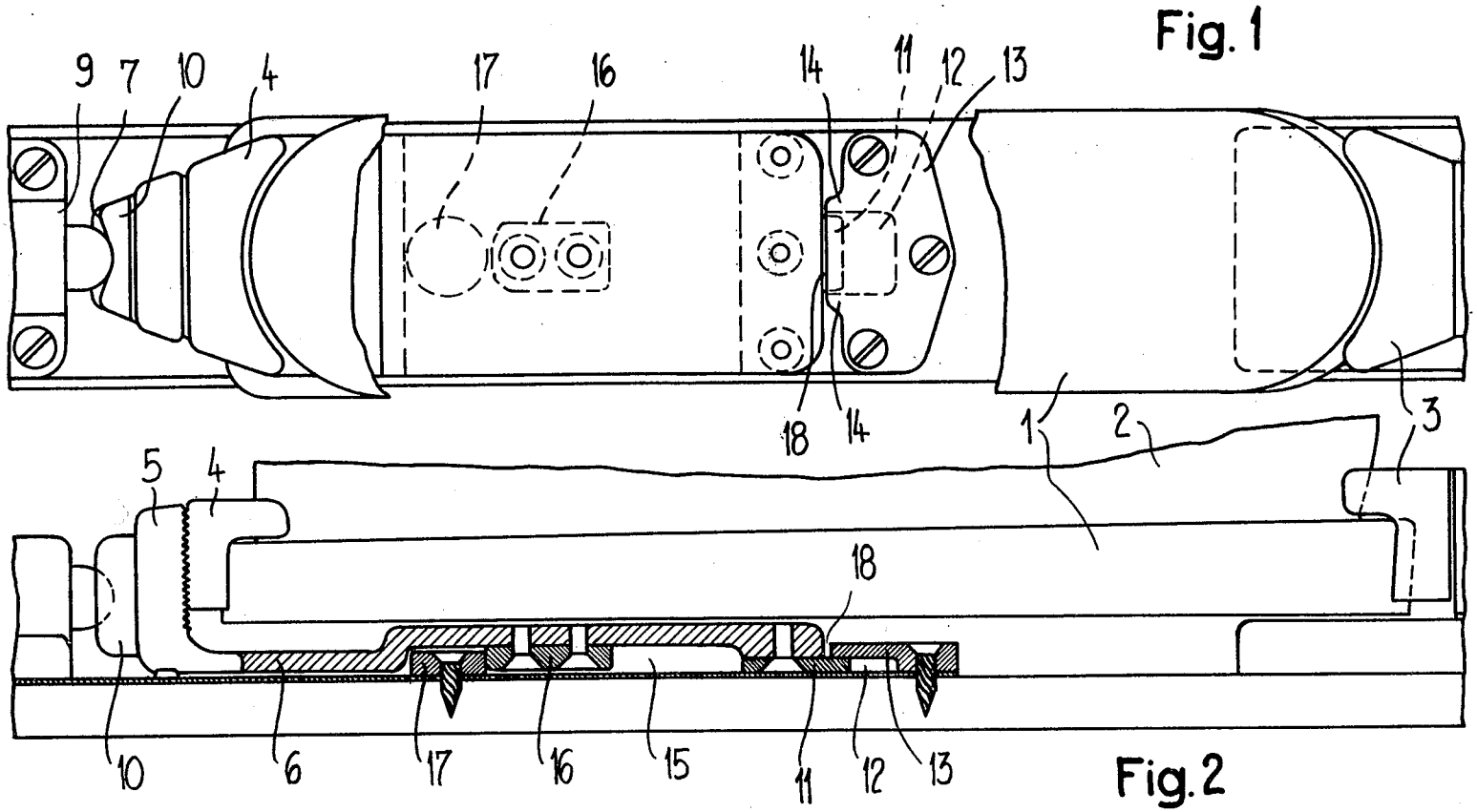
FIG. 1 is a schematic top plan view of a first exemplary embodiment of the safety ski binding of the invention.
FIG. 2 is a side view of the safety ski binding of FIG. 1.

Referring now to the drawings, throughout the various Figures illustrating the different embodiments of the safety ski binding as contemplated by the invention it is to be understood that the same or analogous components have been generally designated by the same reference characters.

With the embodiment of FIGS. 1 and 2 the sole 1 of the ski boot 2 is clamped between a heel portion or automatic heel portion 3 and a jaw 4 (also referred to as toe jaw) of the ski binding. The heel portion 3 of the binding can be of any random construction. This binding component has assigned to it the function of the heel holder and a step-in function and safety release function.

The jaw 4 is adjustably secured at the upwardly flexed web 5 of a plate 6 engaging beneath the ski boot sole 1. The web 5 carries a projection 10 provided with a recess 7 into which engages the spherical-shaped end of a spring-loaded locking element 9. This element 9 is mounted in a housing anchored to the ski so as to be forwardly displaceable in the lengthwise direction of the ski against the force of a not particularly illustrated spring, the arrangement being conventionally carried out such that the jaw 4 can be rocked out of the illustrated operable or operational position towards both sides and upwardly.

The rear end of the plate 6 possesses a flat extension or projection 11 which engages into a recess 12 of a holder portion or component 13 attached to the ski. The extension 11 and the walls of the holder portion 13 engaging thereover from the sides form pairs of stops 14 which are spaced or offset with respect to the lengthwise axis of the ski towards the one or the other side. These stop pairs 14 form a pivot bearing in that the plate 6, after overcoming the spring force acting upon the locking element 9, can rock about the one stop pair or the other stop pair, respectively. With suitable construction of the extension or projection 11 the plate 6 also can still be rocked upwardly, during a fall towards the rear.

In a recess 15 formed by an offset or raised upwardly extending portion of the plate 6 there is arranged a stop 16 secured to the underside of the plate 6, this stop 16 coacting with a counter support 17 attached to the ski and for instance in the form of a substantially cylindrical bearing disk or plug. The counter support 17 also coacts with a vertical abutment formed on the offset portion of the plate on the underside thereof. This condition is present when the ski boot sole 1 is clamped between the jaw 4 and the heel portion 3, as shown in the drawing. This constitutes the actual operational position of the safety ski binding in which the release characteristic of both the automatic heel portion as well as also the front release component possess the correct behavior. Moreover, and as indicated by reference character 18, a certain amount of play is present with this embodiment between the holder portion or component 13 and the rear end of the plate 6. This play is not only of significance during lateral release. It allows the plate to be inserted more easily into the binding (also to be removed therefrom), since the spring acting upon the locking element 9 can relax somewhat owing to the play 18 when the binding is not in use. The arrangement could also be carried out such that the counter support 17 supports the plate without play in the lengthwise direction of the ski. Further, the stop 16 can possess a convex support surface.

As should be appreciated for this embodiment of the safety ski binding as well as the others disclosed herein there are combined the advantages of conventional jaw-heel bindings with those of the plate bindings. In particular, by virtue of the automatic heel portion there is insured the release towards the front and additionally the "stepping" into the binding when putting on the skis. The plate 6 in turn insures for an always constant frictional behavior and therefore for a positive lateral release (torsion release), this being particularly also then the case if the binding should respond when the skier leans towards the front.

Figures 3, 4:
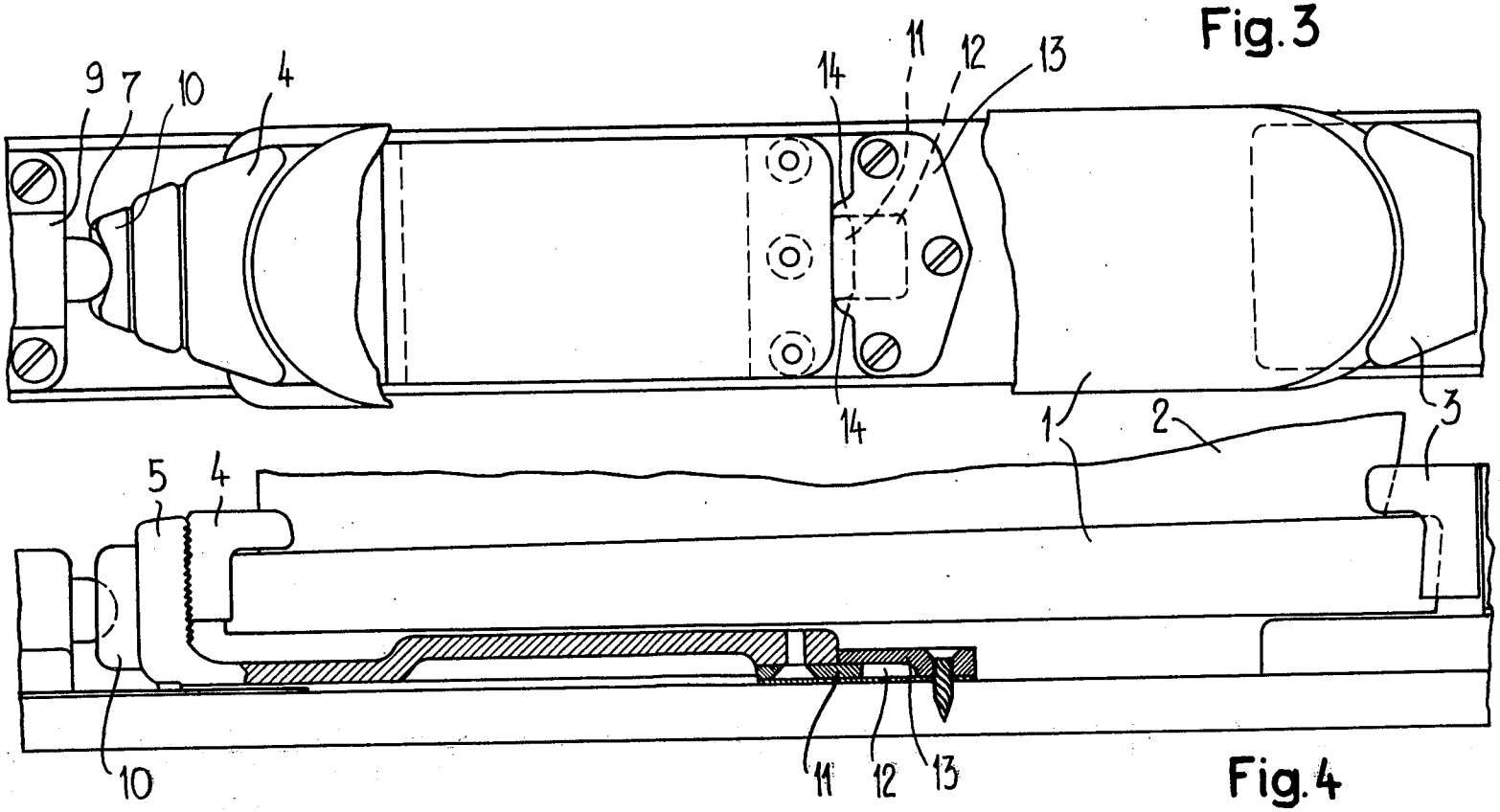
FIG. 3 is a schematic top plan view of a second embodiment of the safety ski binding of the invention.
FIG. 4 is a side view of the safety ski binding of FIG. 3.
Figures 5, 6:
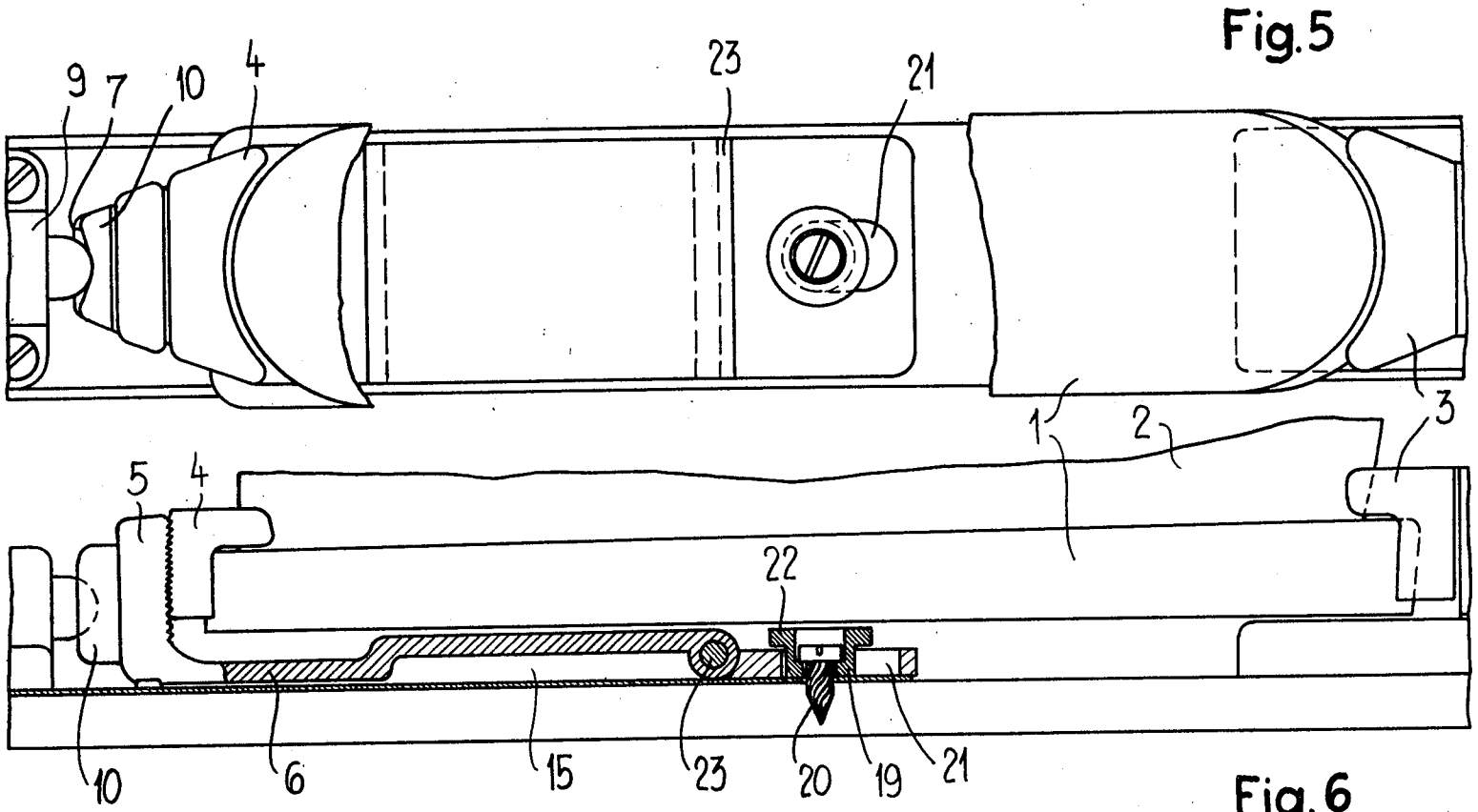
FIG. 5 is a schematic top view of a third embodiment of the safety ski binding of the invention.
FIG. 6 is a side view of the safety ski binding of FIG. 5.
Figures 7, 8:
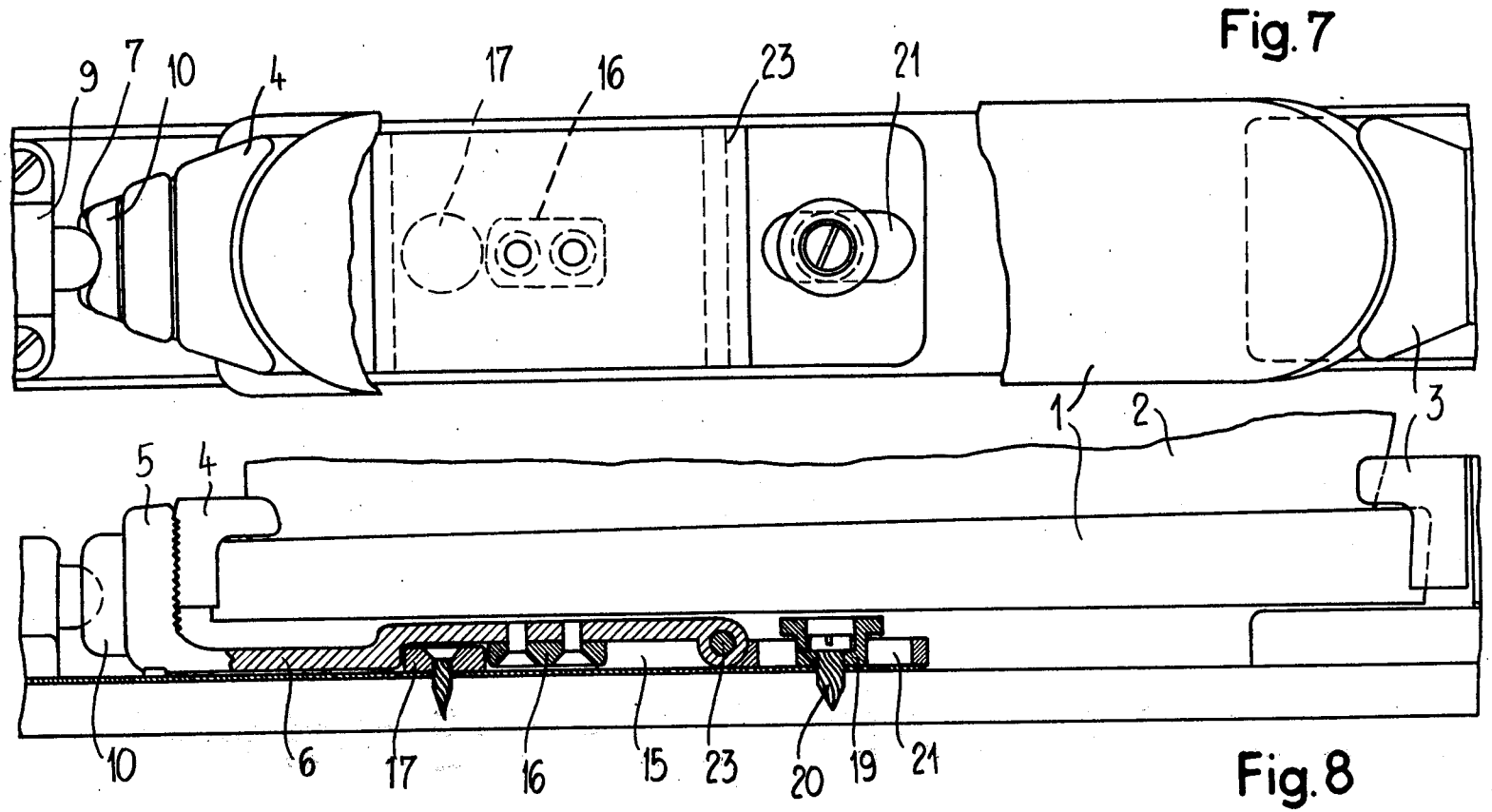
FIG. 7 is a schematic top view of a fourth embodiment of the safety ski binding of the invention.
FIG. 8 is a side view of the safety ski binding of FIG. 7.

The embodiment of safety ski binding depicted in FIGS. 3 and 4 differs from the previously described embodiment by the omission of the stop 16 and the counter support 17. In this case the arrangement is such that the spring force acting upon the locking element 9 continually presses the plate 6 towards the holder portion or component 13, i.e., also then when the boot is clamped into the binding. Under these conditions the adjustment of the locking element 9 and the automatic heel portion 3 is correct. Of course, the same measures could be provided equally in conjunction with the embodiment of FIGS. 1 and 2: also in this case there could be dispensed with the play 18. On the other hand, the counter support 17 could engage without play between the stop 16 and the offset portion of the plate 6. For the embodiments of FIGS. 1 and 2 on the one hand and FIGS. 3 and 4 on the other hand there is equally applicable the fact that the holder portion 13 engages over the extension 11 from the top in such a manner that the plate 6 during a rearward fall of the skier can tilt or rock towards the rear when the locking element 9 releases the pivotal jaw 4.

With the exemplary embodiments according to FIGS. 5, 6 and 7, 8, respectively, the pivot bearing of the plate 6 embodies a bearing pin 19 which is anchored to the ski by means of a screw 20 or equivalent structure and engages in a slot 21 at the rear end of the plate 6. Since with the illustrated embodiments the bearing pin 19 engages over the edge of the slot 21 by means of its annular or ring-shaped shoulder 22, the plate 6 is provided with a hinge 23 or equivalent structure between the slot 21 and its forward end in order to render possible an upward raising or rocking of the plate during a rearward fall of the skier. With the embodiment of FIGS. 7 and 8 there is again provided a stop 16 and a counter support 17. In this case the bearing pin 19 is located between both ends of the slot 21. Also in this instance the arrangement can be carried out such that the counter support 17 can be received without play between the stop 16 and the offset portion of the plate. With the embodiment of FIGS. 5 and 6 there is absent the stop 16 and the counter support 17. Hence, the forward end of the slot 21 serves as a stop which coacts with the bearing pin 19 and which is responsible for the correct adjustment of the locking element 9 and the automatic heel portion 3. Since the plate 6 is constructed as a semi-plate, the spacing between the bearing pin 19 or the holder portion 13 and the locking element is relatively small, so that the bending-through of the ski cannot appreciably affect the correctness of the adjustment setting of the locking element 9. The conditions are even better in this regard as concerns the embodiments of FIGS. 1, 2 and 7, 8, respectively, since in this instance the vertical support of the plate —that is, the counter support 17— is arranged directly at the region of the locking element 9.

In all embodiments, whenever it is necessary for the safety ski binding to carry out its release action, the ski boot is completely released towards the side, forwardly or towards the rear. The plate which is preferably constructed as a semi-plate nonetheless fulfills its function during the lateral release action and it insures for an always constant release moment and also a favorable frictional coefficient which always remains constant. Hence, there is thus realized a heel-jaw binding which during the lateral release action is rendered independent of the ski boot.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A safety ski binding for releasably securing a ski boot having a ski boot sole to a ski, comprising;

an automatic heel portion means for permitting forward release of the ski boot;

a toe jaw arranged in spaced relation to said automatic heel portion means, said ski boot being received between said automatic heel portion means and said toe jaw;

a laterally pivotable plate secured to said toe jaw and extending between said toe jaw and said automatic heel portion means a distance less than the spacing therebetween and from said toe jaw at least to a location beneath the ball of the foot of a skier when said ski boot is disposed in said safety ski binding between said toe jaw and said automatic heel portion means, said plate including an upwardly extending portion having a substantially vertical surface defining abutment means;

stop means arranged on the underside of said plate in longitudinally spaced, confronting relation with said abutment means;

counter support means fixed to the ski and arranged beneath said plate in non-contacting relation with the sole of said ski boot, said counter support means having a substantially vertical surface means engaging between said abutment means and said stop means for preventing movement of said plate along the longitudinal axis of the ski and for permitting lateral movement of said plate relative to said counter support means;

bearing means cooperating with said plate for enabling lateral pivotal movement of said plate about a point longitudinally spaced from said counter support means;

means for releasably fastening the plate to the ski, said fastening means comprising a spring-loaded locking means arranged forwardly of and cooperating with said plate for enabling lateral pivotal movement of said plate.

2. The safety ski binding as defined in claim 1, further including means for connecting said plate with said bearing means and for permitting forward longitudinal movement of said plate relative to said bearing means.

3. The safety ski binding as defined in claim 1, wherein said counter support means is located between said toe jaw and said bearing means.

4. The safety ski binding as defined in claim 2, wherein said bearing means comprises a substantially cylindrical bearing pin fixedly secured to the ski and said connecting means comprises a slot in said plate, said bearing pin engaging in said slot.

5. The safety ski binding as defined in claim 1, wherein said fastening means further includes means mounting said plate for movement about a transverse axis for permitting said plate to pivot upwardly and in the direction of said automatic heel portion means.

6. The safety ski binding as defined in claim 1, wherein said plate comprises two parts hingedly connected about a transverse axis located between said counter support means and said bearing means.

7. The safety ski binding as defined in claim 2, wherein said bearing means and said connecting means comprise a holder portion secured to the ski and two pair of cooperating stops on said plate and said holder portion, one pair of stops being located to one side of the longitudinal axis of the ski and the other pair of stops being located to the other side thereof.

8. The safety ski binding as defined in claim 7, wherein said plate includes a rearward end, said rearward end having a substantially flat extension, having two sides, said holder portion engaging both sides of said extension thereby forming said two pair of stops.

9. The safety ski binding as defined in claim 8, wherein said extension engages beneath said holder portion and is retained such that said plate is upwardly tiltable in the direction of said automatic heel portion means to permit rearward release of the ski boot.

10. The safety ski binding as defined in claim 1, wherein said counter support means comprises a substantially cylindrical disk.

11. The safety ski binding as defined in claim 1, wherein said stop means includes a substantially vertically extending, convex support surface providing a bearing surface contacting said counter support means.

12. The safety ski binding as defined in claim 4, wherein the bearing pin engages into the slot intermediate the ends thereof.

13. The safety ski binding as defined in claim 4, wherein the bearing pin engages over the edges of said slot and said plate being provided with hinge means between said slot and the pivotal jaw for allowing upward tilting of said plate.

* * * * *